US007825752B2

(12) United States Patent
Okada et al.

(10) Patent No.: US 7,825,752 B2
(45) Date of Patent: Nov. 2, 2010

(54) DIELECTRIC FILTER HAVING A DIELECTRIC BLOCK WITH INPUT/OUTPUT ELECTRODES OF A BENT SHAPE AT CORNER PORTIONS OF THE BLOCK

(75) Inventors: Takahiro Okada, Moriyama (JP); Masayuki Atokawa, Ishikawa-ken (JP); Takayoshi Yui, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 12/504,901

(22) Filed: Jul. 17, 2009

(65) Prior Publication Data

US 2009/0267708 A1 Oct. 29, 2009

Related U.S. Application Data

(63) Continuation of application No. PCT/JP2008/059426, filed on May 22, 2008.

(30) Foreign Application Priority Data

Jul. 24, 2007 (JP) ..... 2007-191599

(51) Int. Cl.
*H01P 1/205* (2006.01)

(52) U.S. Cl. ..... 333/202; 333/206

(58) Field of Classification Search ..... 333/202, 333/206, 134

See application file for complete search history.

(56) References Cited

U.S. PATENT DOCUMENTS 5,023,580 A * 6/1991 Kim et al. ..... 333/206
5,045,824 A * 9/1991 Metroka ..... 333/206
6,204,738 B1 * 3/2001 Toda et al. ..... 333/206
6,356,169 B1 3/2002 Toda et al.

FOREIGN PATENT DOCUMENTS

| | | |
|---|---|---|
| JP | 6-77306 | 10/1994 |
| JP | 8-32310 | 2/1996 |
| JP | 2000-174502 | 6/2000 |
| JP | 2004-165781 | 6/2004 |

OTHER PUBLICATIONS

PCT/JP2008/059426 International Search Report dated Jun. 18, 2008.

PCT/JP2008/059426 Written Opinion dated Jun. 18, 2008.

* cited by examiner

*Primary Examiner*—Benny Lee
(74) *Attorney, Agent, or Firm*—Dickstein Shapiro LLP

(57) ABSTRACT

A dielectric filter having a dielectric block disposed on a mount board. The dielectric block includes inner conductor holes having open ends on the front surface of the dielectric block. Input/output electrodes are disposed on the undersurface of the dielectric block. Each of the input/output electrodes extends from the boundary between a side surface and the undersurface of the dielectric block to the boundary between the front surface and the undersurface of the dielectric block. An outer conductor includes undersurface electrode corner portions and an undersurface electrode main portion. Each of the undersurface electrode corner portions is disposed at a corner formed by the front surface and one of the side surfaces of the dielectric block.

12 Claims, 7 Drawing Sheets

1
33A
2
4A
5A
32
5B
4B
5C
61
33B
3

1
33A
31A
64A
4A
64B
32
2
33B
31B
64D
4B
64C
3

1
33A
3
2
4A
62

11
61
33A
2
43A
5A
51A
5B
51B
43B
5C
51C
33B
3

11
31A
64A
41A
64B
32
2
31B
64D
41B
64C
3

11
62
42A
2
3

13
61
33A
2
5A
53A
5B
53B
5C
53C
33B
3

13
2
31A
64A
41A
64B
32
31B
64D
41B
64C
3

13
62
42A
2
3

DIELECTRIC FILTER HAVING A DIELECTRIC BLOCK WITH INPUT/OUTPUT ELECTRODES OF A BENT SHAPE AT CORNER PORTIONS OF THE BLOCK

CROSS REFERENCE TO RELATED APPLICATIONS

The present application is a continuation of International Application No. PCT/JP2008/059426, filed May 22, 2008, which claims priority to Japanese Patent Application No. JP2007-191599, filed Jul. 24, 2007, the entire contents of each of these applications being incorporated herein by reference in their entirety.

FIELD OF THE INVENTION

The present invention relates to a dielectric filter having an outer conductor formed on an outer surface of a dielectric block, an inner conductor formed in an inner conductor formation hole, and an input/output terminal that is formed on a part of the outer surface and is coupled to the inner conductor.

BACKGROUND OF THE INVENTION

A dielectric filter in which a resonator is obtained by forming an inner conductor and an outer conductor at a dielectric block is widely used (see, for example, Patent Document 1).

FIGS. 1(A) and 1(B) are perspective views of a dielectric filter in the prior art disposed on a mount board as viewed from an upper surface. A left front surface of a dielectric filter in the drawing is hereinafter referred to as a front surface, and a right front surface of the dielectric filter in the drawing is hereinafter referred to as a right side surface. FIG. 1(A) is a diagram describing a dielectric filter disposed on a mount board 201. FIG. 1(B) is a diagram describing a dielectric filter disposed on a mount board 301.

A dielectric filter 101 includes a dielectric block 102. The dielectric block 102 is a rectangular parallelepiped, and includes three resonators. On an outer surface excluding a front surface that is an open surface of the dielectric block 102, an outer conductor 103 and input/output electrodes 104A and 104B are disposed. Inner conductor formation holes passing from the front surface to the back surface of the dielectric block 102 are disposed. Inner conductors 105A, 105B, 105C are individually disposed on the inner surfaces of the inner conductor formation holes. Each of the inner conductors 105A to 105C has one end on the front surface of the dielectric block 102 as an open end and the other end connected to the outer conductor 103 on the back surface of the dielectric block 102. In order to obtain strong external coupling between an input (output) resonator formed by the inner conductor 105A and the input/output electrode 104A and between an output (input) resonator formed by the inner conductor 105C and the input/output electrode 104B, the input/output electrodes 104A and 104B are individually disposed near the open ends of these resonators. More specifically, the input/output electrode 104A is formed from a corner formed by the front surface and the left side surface of the dielectric block 102 on the undersurface of the dielectric block 102 to the left side surface of the dielectric block 102, and the input/output electrode 104B is formed from a corner formed by the front surface and the right side surface of the dielectric block 102 on the undersurface of the dielectric block 102 to the right side surface of the dielectric block 102.

When the dielectric filter 101 is disposed on a mount board 201, the outer conductor 103 is connected to a ground electrode 202 of the mount board 201 and the input/output electrodes 104A and 104B are individually connected to signal lines 203A and 203B of the mount board 201 on the undersurface of the dielectric block 102.

The mount board 201 illustrated in FIG. 1(A) includes coplanar signal lines 203A and 203B. The signal lines 203A and 203B extend so that they are parallel to each other. On the mount board 201, the dielectric filter 101 is disposed so that the front surface thereof is perpendicular to a direction in which the signal lines 203A and 203B extend. The signal lines 203A and 203B are connected to the input/output electrodes 104A and 104B from the front surfaces of the input/output electrodes 104A and 104B, respectively.

The mount board 301 illustrated in FIG. 1(B) includes coplanar signal lines 303A and 303B, and a ground electrode 302. The signal lines 303A and 303B are disposed on the same line so that the leading ends thereof are apart by a fixed distance. On the mount board 301, the dielectric filter 101 is disposed so that the right side surface thereof and the left side surface thereof are perpendicular to a direction in which the signal lines 303A and 303B extend. The signal lines 303A and 303B are connected to the input/output electrodes 104A and 104B from the side surfaces of the input/output electrodes 104A and 104B, respectively.

[Patent Document 1] Japanese Unexamined Patent Application Publication No. 200-174502

In the above-described dielectric filter, since the ground electrode of the mount board is at a ground potential, a ground current flows through the outer conductor on the side surfaces and the upper surface of the dielectric block. Accordingly, the potential of the outer conductor on the dielectric block is substantially the same as the ground potential.

In reality, however, since a part of the outer conductor having a length corresponding to the wavelength of a target high-frequency signal for the dielectric filter is apart from the ground electrode, the potential of the part of the outer conductor is apart from the ground potential at a high frequency. In the above-described dielectric filter, since the input/output electrode is disposed on the undersurface and the side surface of the dielectric block on the side of the front surface (open surface) of the dielectric block, the potential of a part of the outer conductor on the upper sides of the input/output electrodes disposed on the sides of the dielectric block is easily apart from the ground potential at a high frequency. Accordingly, the potential of the upper surface of the dielectric block is easily apart from the ground potential at a high frequency.

In order to prevent the potential of the outer conductor on the upper surface from being apart from the ground potential at a high frequency, a cover is sometimes attached to the open surface so as to make a short circuit between the outer conductor on the upper surface and the ground electrode. In this case, the number of steps and a footprint are increased due to attachment of a cover to the open surface.

SUMMARY OF THE INVENTION

It is an object of the present invention to provide a dielectric filter capable of having a plurality of patterns of connecting an input/output electrode to a signal line of a mount board and preventing the potential of an outer conductor on an upper surface from being apart from a ground potential at a high frequency without using a cover.

A dielectric filter according to the present invention includes a dielectric block, an outer conductor, an inner conductor, and an input/output electrode. The dielectric block is a substantially rectangular parallelepiped, and is disposed on a mount board using an undersurface thereof as a mounting surface. The outer conductor is formed on an outer surface of the dielectric block and is connected to the ground on the mounting surface. The inner conductor has an open end on a front surface of the dielectric block and is formed on an inner surface of an inner conductor formation hole passing through the dielectric block. The input/output electrode is apart from the outer conductor and is coupled to the inner conductor. The input/output electrode includes, on the undersurface of the dielectric block, undersurface input/output electrode portions one of which extends from a boundary between one side surface and the undersurface of the dielectric block to a boundary between the front surface and the undersurface of the dielectric block and the other one of which extends from a boundary between the other side surface and the undersurface of the dielectric block to the boundary between the front surface and the undersurface of the dielectric block. The outer conductor includes, on the undersurface of the dielectric block, undersurface electrode corner portions one of which is disposed at a corner formed by the front surface and one side surface of the dielectric block and the other one of which is disposed at a corner formed by the front surface and the other side surface of the dielectric block, and an undersurface electrode main portion that is disposed between the undersurface electrode corner portions and is apart from the undersurface input/output electrode portions.

In a dielectric filter having the above-described configuration, when the outer conductor on the undersurface is connected to the ground electrode of the mount board, a ground current passes through a path between each of the undersurface electrode corner portions and the outer conductor on the upper surface of the dielectric block without passing through the undersurface input/output electrode portions. Accordingly, even if the pattern of connecting the signal lines of the mount board to the dielectric filter is changed, it is possible to prevent the potential of the outer conductor on the upper surface from being apart from the ground potential at a high frequency. As a result, there can be provided an ideal dielectric filter using TEM-mode resonance.

The outer conductor may include front surface electrode portions. On the front surface of the dielectric block, one of the front surface electrode portions extends from a boundary between the undersurface and the front surface of the dielectric block to a boundary between an upper surface and the front surface of the dielectric block along one side surface of the dielectric block, and the other one of the front surface electrode portions extends from the boundary between the undersurface and the front surface of the dielectric block to the boundary between the upper surface and the front surface of the dielectric block along the other side surface of the dielectric block.

In a dielectric filter having the above-described configuration, when the undersurface electrode corner portions on the undersurface of the dielectric block are connected to the ground electrode of the mount board, a ground current flows near the front surface electrode portions in a concentrated manner in a path between each of the undersurface electrode corner portions and the outer conductor on the upper surface of the dielectric block. Accordingly, it is possible to further prevent the potential of the outer conductor on the upper surface from being apart from the ground potential at a high frequency.

A plurality of the inner conductors may be adjacent to each other. In this case, coupling electrodes may be provided on the front surface of the dielectric block. The coupling electrodes are individually connected to open ends of the plurality of inner conductors so as to generate a mutual capacitance between the open ends of the plurality of inner conductors.

In a dielectric filter having the above-described configuration, capacitive coupling is achieved among resonators that are individually formed by the inner conductors that are adjacent to each other.

It is desirable that one of the coupling electrodes which forms an input-stage resonator and another one of the coupling electrodes which forms an output-stage resonator be individually connected to the undersurface input/output electrode portions.

In a dielectric filter having the above-described configuration, very strong external coupling can be achieved between the input-stage resonator and one of the undersurface input/output electrode portions and between the output-stage resonator and the other one of the undersurface input/output electrode portions.

A front surface strip electrode may be provided on the front surface of the dielectric block. Both ends of the front surface strip electrode are connected to the outer conductor.

In a dielectric filter having the above-described configuration, a ground current path between the outer conductor on the upper surface of the dielectric block and the outer conductor on the mounting surface of the dielectric block via the strip electrode portion can be generated. Accordingly, it is possible to prevent the potential of the outer conductor on the upper surface from being apparent from the ground potential at a high frequency. Furthermore, if the strip electrode portion passes between the open ends of the inner conductors that are adjacent to each other, a capacitance is generated between each of the open ends of the inner conductors and the strip electrode portion. Accordingly, inductive coupling is achieved between resonators formed by the inner conductors.

According to a dielectric filter according to the present invention, the ground current does not pass through the undersurface input/output electrode portions. This leads to the reduction in the length of the ground current path. Accordingly, it is possible to provide a plurality of patterns of connecting the signal line to the input/output electrode and prevent the potential of the outer conductor on the upper surface from being apart from the ground potential at a high frequency without using cover. Consequently, there can be provided an ideal dielectric filter using TEM-mode resonance.

REFERENCE NUMERALS

Figure 1A:
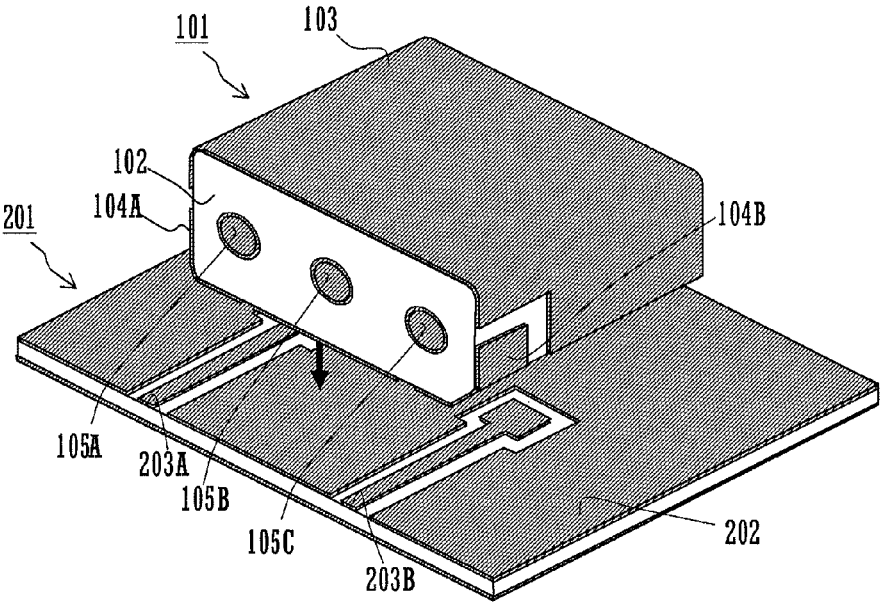
FIG. 1(A) PRIOR ART
FIGS. 1(A) and 1(B) are perspective views of a dielectric filter in the prior art.
Figure 1B:
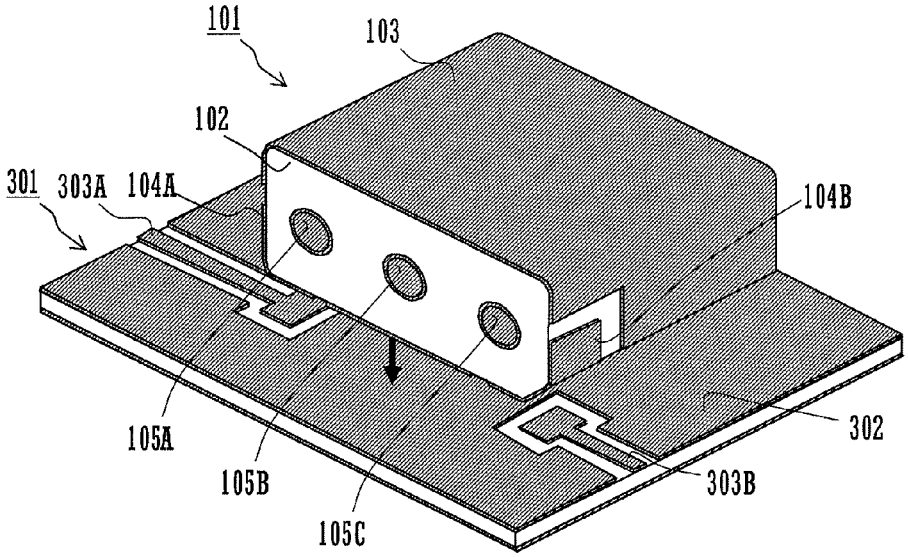
FIG. 1(B) PRIOR ART

1, 11, 12, 13 dielectric filter
2 dielectric block
3 outer conductor
31A, 31B undersurface electrode corner portion
32 undersurface electrode main portion
33A, 33B rectangular front surface electrode portion
34 front surface strip electrode

4A, 4B input/output electrode
41A, 41B undersurface input/output electrode portion
42A side surface input/output electrode portion
43A, 43B front surface input/output electrode portion
5A, 5B, 5C inner conductor
51A front surface open electrode portion
52A, 52B, 52C front surface open electrode portion
53A, 53B, 53C front surface open electrode portion
201, 301 mount board
202, 302 ground electrode
203A, 203B, 303A, 303B signal line

DETAILED DESCRIPTION OF THE INVENTION

An exemplary configuration of a dielectric filter will be described below.

Figures 2A, 2B, 2C:
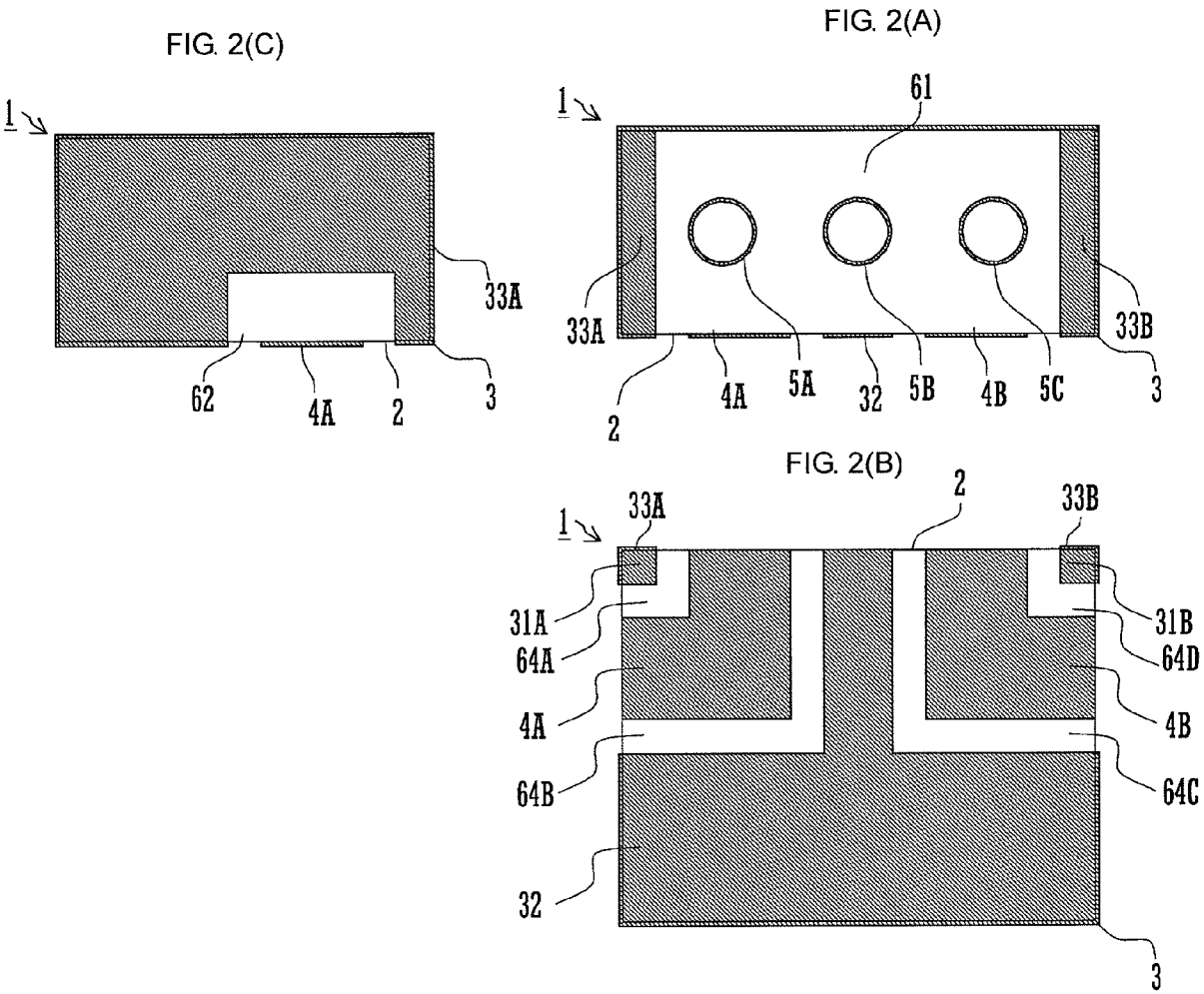
FIGS. 2(A) to 2(C) are developed views illustrating an exemplary configuration of a dielectric filter.

FIGS. 2(A) to 2(C) are developed views of a dielectric filter 1. FIG. 2(A) is a front view of the dielectric filter 1. FIG. 2(B) is a bottom view of the dielectric filter 1. FIG. 2(C) is a left side view of the dielectric filter 1.

The dielectric filter 1 includes a dielectric block 2. The dielectric block 2 is a rectangular parallelepiped block that is formed by a dielectric material having a dielectric constant of 20 and has dimensions of approximately 5 mm wide by approximately 2 mm high by approximately 4 mm deep. The material and dimensions of the dielectric block 2 are not limited to the above-described material and the above-described dimensions.

Three inner conductor formation holes pass from the front surface to the back surface of the dielectric block 2. These inner conductor formation holes are parallel to each other, and have a diameter of approximately 1 mm and a straight structure. Each of these inner conductor formation holes may have a stepped structure in which a diameter is gradually changed in the dielectric block 2, or a hetero-axial structure in which a central axis of a hole is changed in the dielectric block 2. The number of inner conductor formation holes and the structure of each of the inner conductor formation holes are not limited to the above-described number and the above-described structure, respectively.

As shown in FIG. 2(A), inner conductors 5A, 5B, 5C are individually disposed on the inner surfaces of the inner conductor formation holes included in the dielectric block 2. One end of each of the inner conductors 5A to 5C is open on the front surface of the dielectric block 2, and the other end of each of the inner conductors 5A to 5C is connected to an outer conductor 3 on the back surface of the dielectric block 2. Accordingly, the dielectric block 2 includes three quarter-wavelength resonators, and each of these resonators has an open surface on the front surface of the dielectric block 2 and a short-circuited surface on the back surface of the dielectric block 2.

The outer conductor 3 and input/output electrodes 4A and 4B are disposed on the outer surface of the dielectric block 2.

The back surface (not illustrated) of the dielectric block 2 is entirely covered with the outer conductor 3. Furthermore, the upper surface (not illustrated) of the dielectric block 2 is also entirely covered with the outer conductor 3.

As illustrated in FIG. 2(A), on the front surface of the dielectric block 2, a rectangular electrode unformed region 61 is formed which is obtained by partially removing the outer conductor 3 from the front surface of the dielectric block 2 by laser processing. The electrode unformed region 61 includes end portions of the inner conductors 5A to 5C, and is formed in an area that is near the center of the front surface of the dielectric block 2 and is surrounded by the top and bottom sides of the front surface of the dielectric block 2, a side apart from the left side of the front surface of the dielectric block 2, and a side apart from the right side of the front surface of the dielectric block 2. A part of the outer conductor 3 remains in a region on the front surface on the side of the right side surface of the dielectric block 2 and a region on the front surface on the side of the left side surface of the dielectric block 2, so that rectangular front surface electrode portions 33A and 33B are formed.

The front surface electrode portion 33A extends from the boundary between the undersurface and the front surface of the dielectric block 2 to the boundary between the upper surface and the front surface of the dielectric block 2 along the left side surface of the dielectric block 2. The front surface electrode portion 33B extends from the boundary between the undersurface and the front surface of the dielectric block 2 to the boundary between the upper surface and the front surface of the dielectric block 2 along the right side surface of the dielectric block 2.

As illustrated in FIG. 2(C), on the left side surface of the dielectric block 2, a rectangular electrode unformed region 62 is formed which is obtained by partially removing the outer conductor 3 from the left side surface of the dielectric block 2 by laser processing. The electrode unformed region 62 extends from a position apart from a side of the left side surface on the side of the front surface of the dielectric block 2 by a predetermined distance to a position near the center of the left side surface on the side of the back surface of the dielectric block 2 along a side of the left side surface on the side of the undersurface of the dielectric block 2. On the right side surface (not illustrated) of the dielectric block 2, a similar rectangular electrode unformed region to unformed region 62 is formed by partially removing the outer conductor 3 from the right side surface of the dielectric block 2 by laser processing so that an electrode pattern of the right side surface of the dielectric block 2 is symmetrical to that of the left side surface of the dielectric block 2.

As illustrated in FIG. 2(B), on the undersurface of the dielectric block 2, curved electrode unformed regions 64A, 64B, 64C, 64D are formed which are obtained by partially removing the outer conductor 3 from the undersurface of the dielectric block 2 by laser processing. As a result, on the undersurface of the dielectric block 2, the input/output electrodes 4A and 4B, undersurface electrode corner portions 31A and 31B, and an undersurface electrode main portion 32 are disposed.

The input/output electrodes 4A and 4B correspond to undersurface input/output electrode portions according to the present invention. On the undersurface of the dielectric block 2, the input/output electrode 4A curves from the boundary between the left side surface and the undersurface of the dielectric block 2 to the boundary between the front surface and the undersurface of the dielectric block 2. The input/output electrode 4A is surrounded by the electrode unformed region 62 on the left side surface of the dielectric block 2, the electrode unformed region 61 on the front surface of the dielectric block 2, and the electrode unformed regions 64A and 64B. On the undersurface of the dielectric block 2, the input/output electrode 4B curves from the boundary between the right side surface and the undersurface of the dielectric block 2 to the boundary between the front surface and the undersurface of the dielectric block 2. The input/output electrode 4B is surrounded by the electrode unformed region 63 on the right side surface of the dielectric block 2, the electrode unformed region 61 on the front surface of the dielectric block 2, and the electrode unformed regions 64C and 64D.

The undersurface electrode corner portions 31A and 31B and the undersurface electrode main portion 32 form a part of the outer conductor 3. On the undersurface of the dielectric block 2, the undersurface electrode corner portion 31A is disposed at the corner formed by the front surface and the left side surface of the dielectric block 2. The undersurface electrode corner portion 31A is electrically connected to the front surface electrode portion 33A on the front surface of the dielectric block 2 and the outer conductor 3 on the left side surface of the dielectric block 2. On the undersurface of the dielectric block 2, the undersurface electrode corner portion 31B is disposed at the corner formed by the front surface and the right side surface of the dielectric block 2. The undersurface electrode corner portion 31B is electrically connected to the front surface electrode portion 33B on the front surface of the dielectric block 2 and the outer conductor 3 on the right side surface of the dielectric block 2. The undersurface electrode main portion 32 is disposed on the undersurface of the dielectric block 2, and is apart from the undersurface electrode corner portions 31A and 31B via the input/output electrodes 4A and 4B, respectively.

The dielectric filter 1 having the above-described configuration is disposed on a mount board (201 or 301) to be described later using the undersurface thereof that is a mounting surface of the dielectric block 2. The undersurface electrode corner portions 31A and 31B and the undersurface electrode main portion 32, which form the outer conductor 3, are connected to a ground electrode of the mount board, and the input/output electrodes 4A and 4B are individually connected to signal lines of the mount board. As a result, the dielectric filter 1 functions as a filter using the resonance of three resonators in a TEM mode.

Since the input/output electrodes 4A and 4B are individually disposed near the open end of an input-stage resonator and the open end of an output-stage resonator, it is possible to obtain strong external coupling between an input-stage (or output-stage) resonator formed by the inner conductor 5A and the input/output electrode 4A and between an output-stage (or input-stage) resonator formed by the inner conductor 5C and the input/output electrode 4B.

If the undersurface electrode corner portions 31A and 31B on the undersurface of the dielectric block 2 are connected to the ground electrode of the mount board, a ground current flows between each of the undersurface electrode corner portions 31A and 31B and the outer conductor 3 on the upper surface of the dielectric block. The ground current flows near the front surface electrode portions 33A and 33B in a concentrated manner without flowing through the input/output electrodes 4A and 4B, and therefore flows through a substantially straight path from the undersurface electrode corner portions 31A and 31B to the outer conductor on the upper surface of the dielectric block 2. Accordingly, it is possible to prevent the potential of the outer conductor 3 on the upper surface from being apart from the ground potential at a high frequency.

Figure 3A:
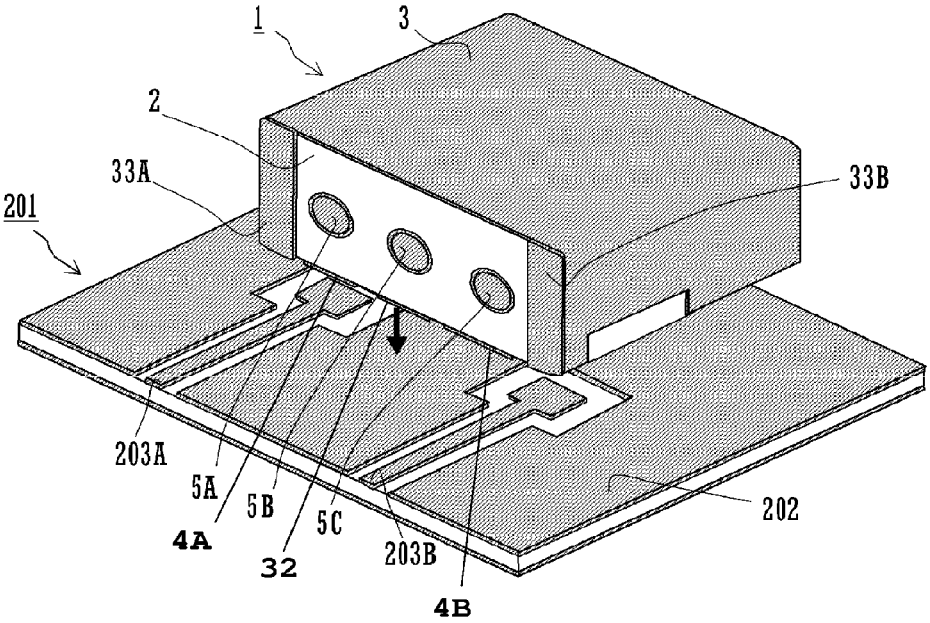
FIGS. 3(A) and 3(B) are perspective views of the dielectric filter disposed on a mount board.
Figure 3B:
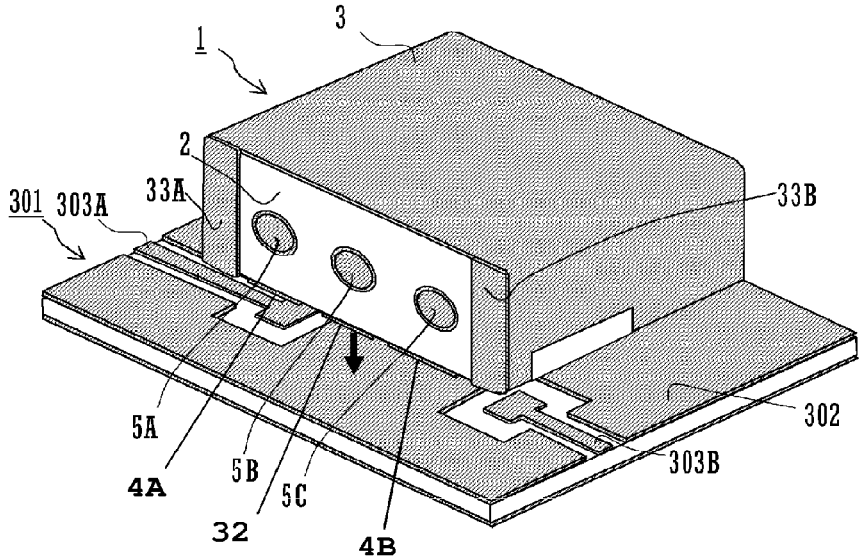

Next, the mounting state of the dielectric filter 1 on a mount board will be described. FIGS. 3(A) and 3(B) are perspective views of the dielectric filter 1 disposed on a mount board as viewed from the upper surface of the dielectric filter 1. A left front surface of the dielectric filter 1 in the drawing is hereinafter referred to as a front surface, and a right front surface of the dielectric filter 1 in the drawing is hereinafter referred to as a right side surface.

FIG. 3(A) is a perspective view of the dielectric filter 1 disposed on the mount board 201 as viewed from the upper surface of the dielectric filter 1. On the undersurface of the dielectric block 2 that is a mounting surface of the dielectric block 2, the outer conductor 3 is connected to a ground electrode 202 of the mount board 201 and the input/output electrodes 4A and 4B are connected to the signal lines 203A and 203B of the mount board 201, respectively.

The mount board 201 includes the coplanar signal lines 203A and 203B. The signal lines 203A and 203B extend so that they are parallel to each other. The dielectric filter 1 is disposed on the mount board 201 so that the front surface thereof is perpendicular to a direction in which the signal lines 203A and 203B extend. The signal lines 203A and 203B that extend from the front surfaces of the input/output electrodes 4A and 4B are connected to the input/output electrodes 4A and 4B, respectively.

FIG. 3(B) is a perspective view of the dielectric filter 1 disposed on the mount board 301 as viewed from the upper surface of the dielectric filter 1. On the undersurface of the dielectric block 2 which is a mounting surface of the dielectric block 2, the outer conductor 3 is connected to a ground electrode 302 of the mount board 301 and the input/output electrodes 4A and 4B are connected to the signal lines 303A and 303B of the mount board 301, respectively.

The mount board 301 includes the coplanar signal lines 303A and 303B. The signal lines 303A and 303B are disposed on the same line so that the leading ends of the signal lines 303A and 303B are apart by a fixed distance. The dielectric filter 1 is disposed on the mount board 301 so that the right side surface and the left side surface thereof are perpendicular to a direction in which the signal lines 303A and 303B extend. The signal lines 303A and 303B that extend from the side surfaces of the input/output electrodes 4A and 4B are connected to the input/output electrodes 4A and 4B, respectively.

Thus, the dielectric filter 1 can be connected to signal lines of a mount board which extend from a plurality of directions. In both of a case in which signal lines extending from a front surface are individually connected to the input/output electrodes 4A and 4B and a case in which signal lines extending from side surfaces are individually connected to the input/output electrodes 4A and 4B, it is possible to prevent the potential of the outer conductor 3 on the upper surface from being apart from the ground potential at a high frequency.

Figure 4:
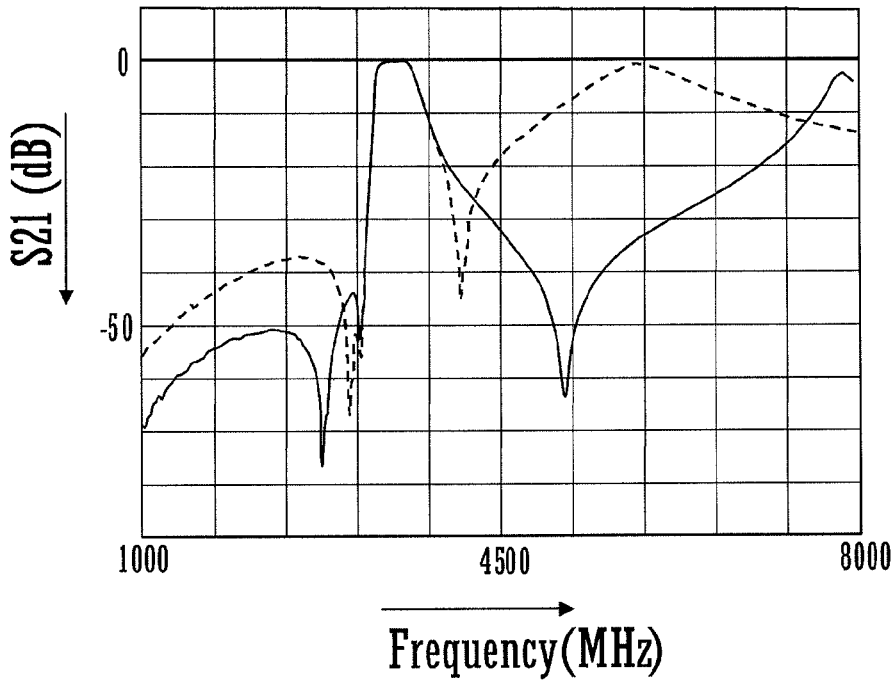
FIG. 4 is a graph illustrating the filter characteristic of the dielectric filter.

Next, the transmission characteristic of the dielectric filter 1 will be described. FIG. 4 is a diagram illustrating a transmission characteristic S21 of the dielectric filter 1 which is obtained from simulations. In the drawing, a solid line represents a transmission characteristic of a dielectric filter according to the present invention and a dotted line represents a transmission characteristic of a dielectric filter to be compared with a dielectric filter according to the present invention which includes no undersurface electrode corner portion.

Each of these dielectric filters is a TEM-mode BPF (Band Pass Filter) for transmitting a signal in a frequency range of 3300 MHz to 3600 MHz. Among three resonators included in each of these dielectric filters, capacitive coupling is obtained between adjacent resonators. As a result, a band characteristic having two steep attenuation poles on the lower frequency sides of passbands can be obtained.

In a waveform S21 of a dielectric filter according to the present invention, a resonance frequency in a TEM mode used for a BPF is near a frequency of 3450 MHz, a passband is near a frequency range of 3300 MHz to 3600 MHz, an attenuation pole having an attenuation amount of approximately −78 dB is near a frequency of 2700 MHz on the lower side of the passband, an attenuation pole having an attenuation amount of approximately −52 dB is near a frequency of 3200 MHz, and a resonance frequency in a TE mode that is a spurious mode is near a frequency of 7800 MHz.

On the other hand, in a resonance waveform of a dielectric filter to be compared with a dielectric filter according to the present invention, like in the waveform S21, a resonance frequency in a TEM mode used for a BPF is near a frequency of 3450 MHz and a passband is near a frequency range of 3300 MHz to 3600 MHz. However, the resonance waveform of a dielectric filter to be compared with a dielectric filter according to the present invention differs from the waveform S21 in that an attenuation pole having an attenuation amount of approximately −67 dB is near a frequency of 3000 MHz on the lower side of the passband, an attenuation pole having an attenuation amount of approximately −56 dB is near a frequency of 3200 MHz, and a resonance frequency in a TE mode is near a frequency of 5800 MHz.

The above-described simulation results show that a resonance frequency in the TE mode, which is a spurious resonance mode, decreases to a frequency nearer to a resonance frequency in the TEM mode in a dielectric filter to be compared with a dielectric filter according to the present invention. Accordingly, over the whole range of illustrated frequencies (1000 MHz to 8000 MHz), the amount of attenuation is small. On the other hand, in a dielectric filter according to the present invention, since a resonance frequency in the TE mode is high, a large amount of attenuation can be obtained over the whole range of illustrated frequencies (1000 MHz to 8000 MHz). Furthermore, in a dielectric filter according to the present invention, it is possible to obtain an attenuation pole having a larger amount of attenuation than that obtained in a dielectric filter to be compared with a dielectric filter on the lower side of a passband. This contributes to the achievement of a large amount of attenuation on the lower side of a passband.

Next, another exemplary configuration of a dielectric filter will be described.

Figures 5A, 5B, 5C:
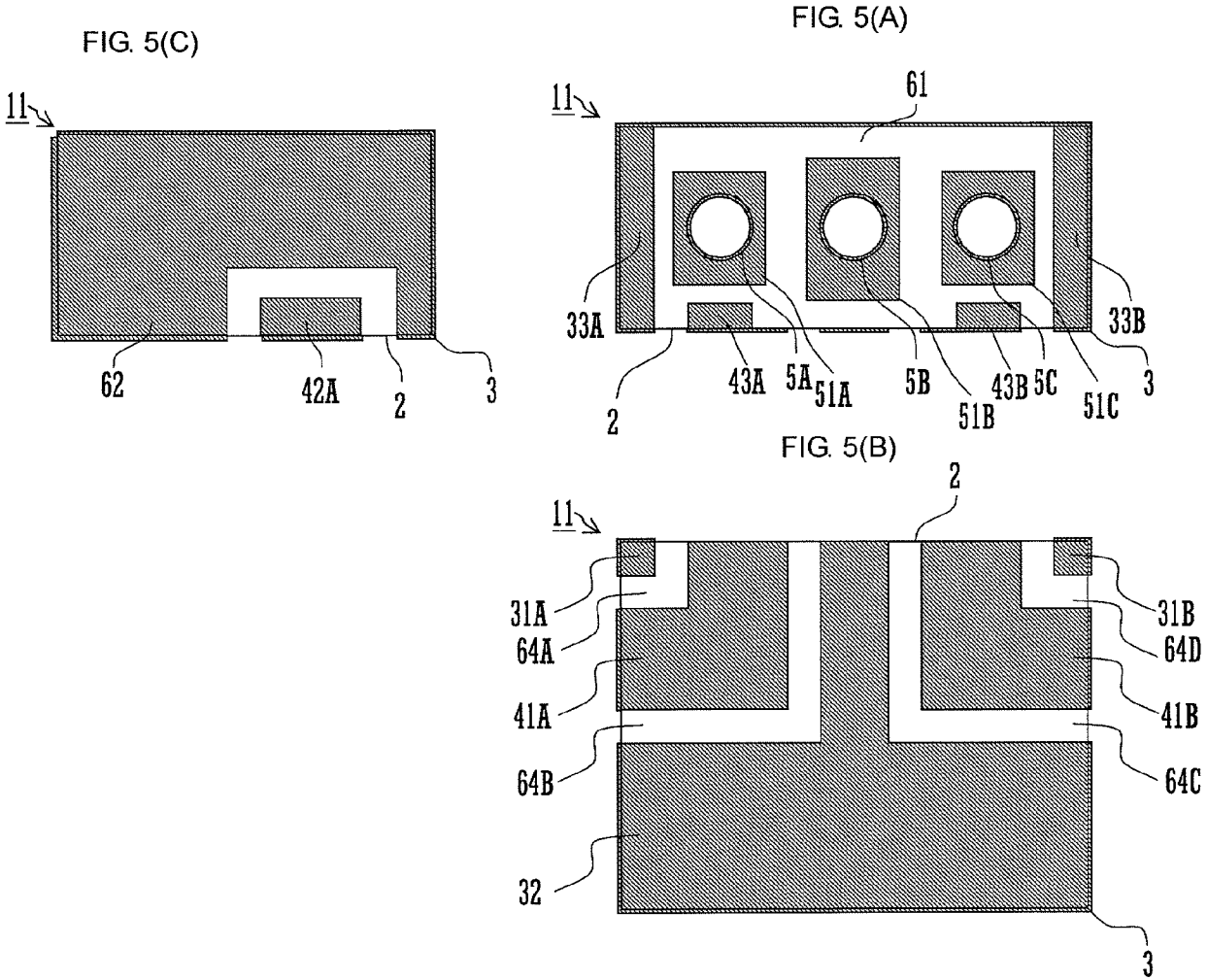
FIG. 5(A) to 5(C) are diagrams describing another exemplary configuration of a dielectric filter.

FIGS. 5(A) to 5(C) are developed views of a dielectric filter 11. In the drawing, the same reference numerals are used to represent the same components included in the above-described dielectric filter.

On the outer surface of the dielectric block 2, the outer conductor 3, front surface input/output electrode portions 43A and 43B (as shown in FIG. 5(A)), side surface input/output electrode portions (such as 42A shown in FIG. 5(C)) undersurface input/output electrode portions 41A and 41B (as shown in FIG. 5(B)), and front surface open electrode portions 51A, 51B, 51C (as shown in FIG. 5(A)) are disposed.

The front surface input/output electrode portions 43A and 43B, the side surface input/output electrode portions (such as 42A shown in FIG. 5(C)) and the undersurface input/output electrode portions 41A and 41B individually form input/output electrodes. The area of the input/output electrodes is larger than that of the input/output electrodes 4A and 4B by the area of the front surface input/output electrode portions 43A and 43B and the side surface input/output electrode portions 42A and 42B. As a result, each of the input/output electrodes can obtain strong external coupling.

The front surface open electrode portions 51A 51B 51C (as shown in FIG. 5(A)) are electrically connected to the inner conductors 5A 5B 5C, respectively (as shown in FIG. 5(A)), and are adjacent to each other on the front surface of the dielectric block 2. As a result, mutual coupling among the front surface open electrode portions 51A 51B 51C (as shown in FIG. 5(A)) which is stronger than that among the front surface open electrode portions included in the above-described dielectric filter can be obtained.

Figures 6A, 6B, 6C:
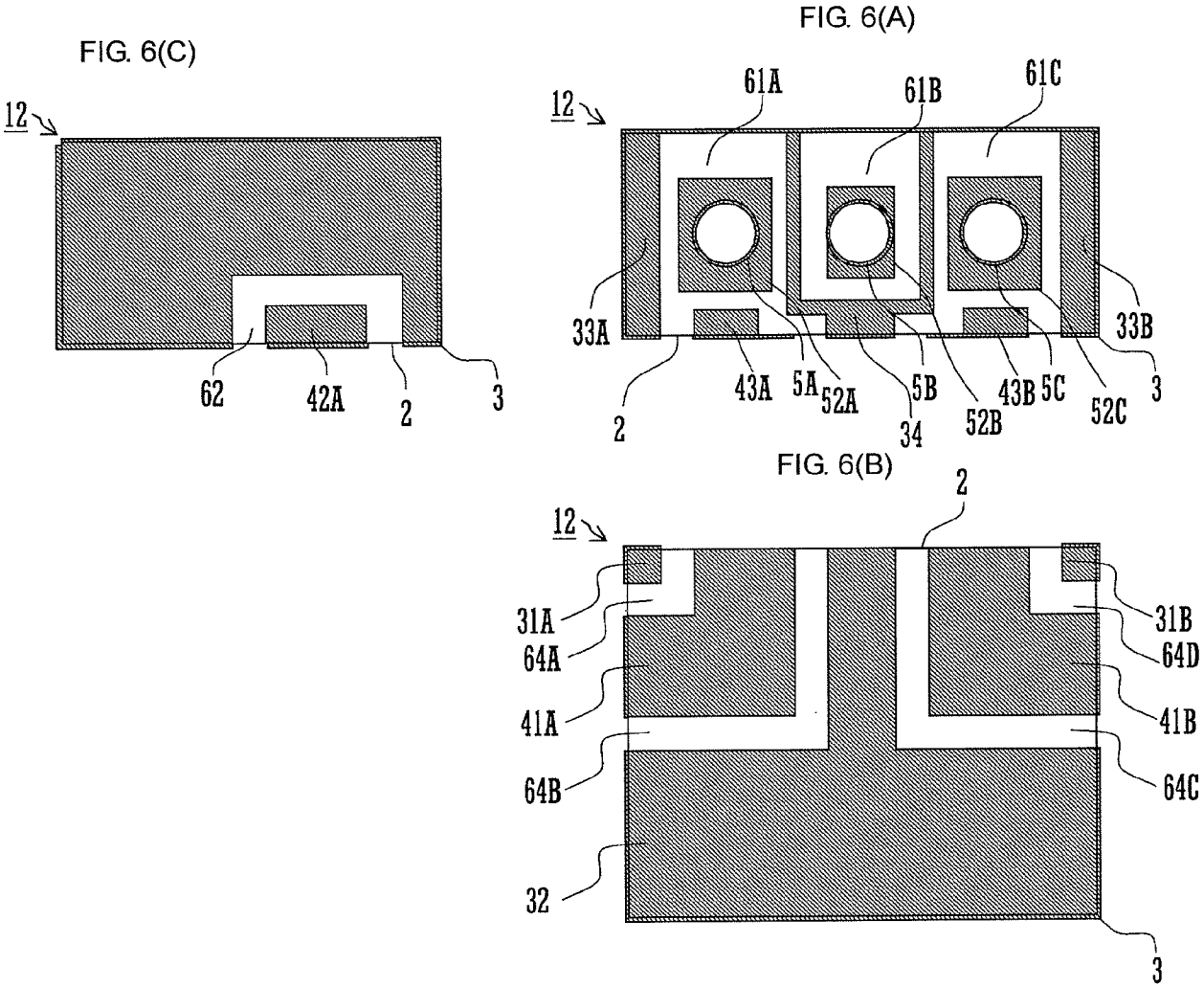
FIG. 6(A) to 6(C) are diagrams describing another exemplary configuration of a dielectric filter.

FIGS. 6(A) to 6(C) are developed views of a dielectric filter 12. In the drawing, the same reference numerals are used to represent the same components included in the above-described dielectric filters.

On the front surface of the dielectric block 2, electrode unformed regions 61A, 61B, 61C (as shown in FIG. 6(A)) are formed which are obtained by partially removing the outer conductor 3 from the front surface of the dielectric block 2 by laser processing. The electrode unformed regions 61A, 61B, 61C include end portions of the inner conductors 5A, 5B, 5C, respectively (as shown in FIG. 6(A)). A front surface strip electrode 34 (as shown in FIG. 6(A)) is disposed among the electrode unformed regions 61A, 61B, 61C that are apart from each other. The front surface strip electrode 34 forms a part of the outer conductor 3. The front surface strip electrode 34 extends from a center of a bottom side of the front surface of the dielectric block 2 to the top side of the front surface of the dielectric block 2, and is bifurcated into two lines. One of the two lines passes between front surface open electrode portions 52A and 52B (as shown in FIG. 6(A)) and is electrically connected to the outer conductor 3 on the upper surface of the dielectric block 2. The other one of the two lines passes between the front surface open electrode portion 52B and a front surface open electrode portion 52C (as shown in FIG. 6(A)) and is electrically connected to the outer conductor 3 on the upper surface of the dielectric block 2.

The front surface strip electrode 34 makes a short circuit between the outer conductor 3 on the upper surface of the dielectric block 2 and the outer conductor 3 on the undersurface of the dielectric block 2. As a result, when the dielectric filter 12 is disposed, it is possible to further prevent the potential of the outer conductor 3 on the upper surface from being apart from the ground potential at a high frequency. Furthermore, it is possible to reduce mutual capacitances among the front surface open electrode portions 52A to 52C and provide stray capacitances between the front surface strip electrode 34 and each of the front surface open electrode portions 52A to 52C. Accordingly, inductive coupling is achieved among resonators formed by the inner conductors 5A to 5C.

Thus, since the front surface strip electrode 34 and the undersurface electrode corner portions 31A and 31B are disposed, it is possible to more effectively prevent the potential of the outer conductor 3 on the upper surface and the side surfaces from being apart from the ground potential at a high frequency when the dielectric filter 12 is disposed.

In this dielectric filter, the front surface strip electrode 34 is symmetric about a central plane passing through the open surface of the front surface of the dielectric block. As a result, a ground current passing through the front surface strip electrode 34 can be symmetric. Accordingly, it is possible to easily connect the outer conductor 3 on the upper surface of the dielectric filter 12 to a ground potential.

Figures 7A, 7B, 7C:
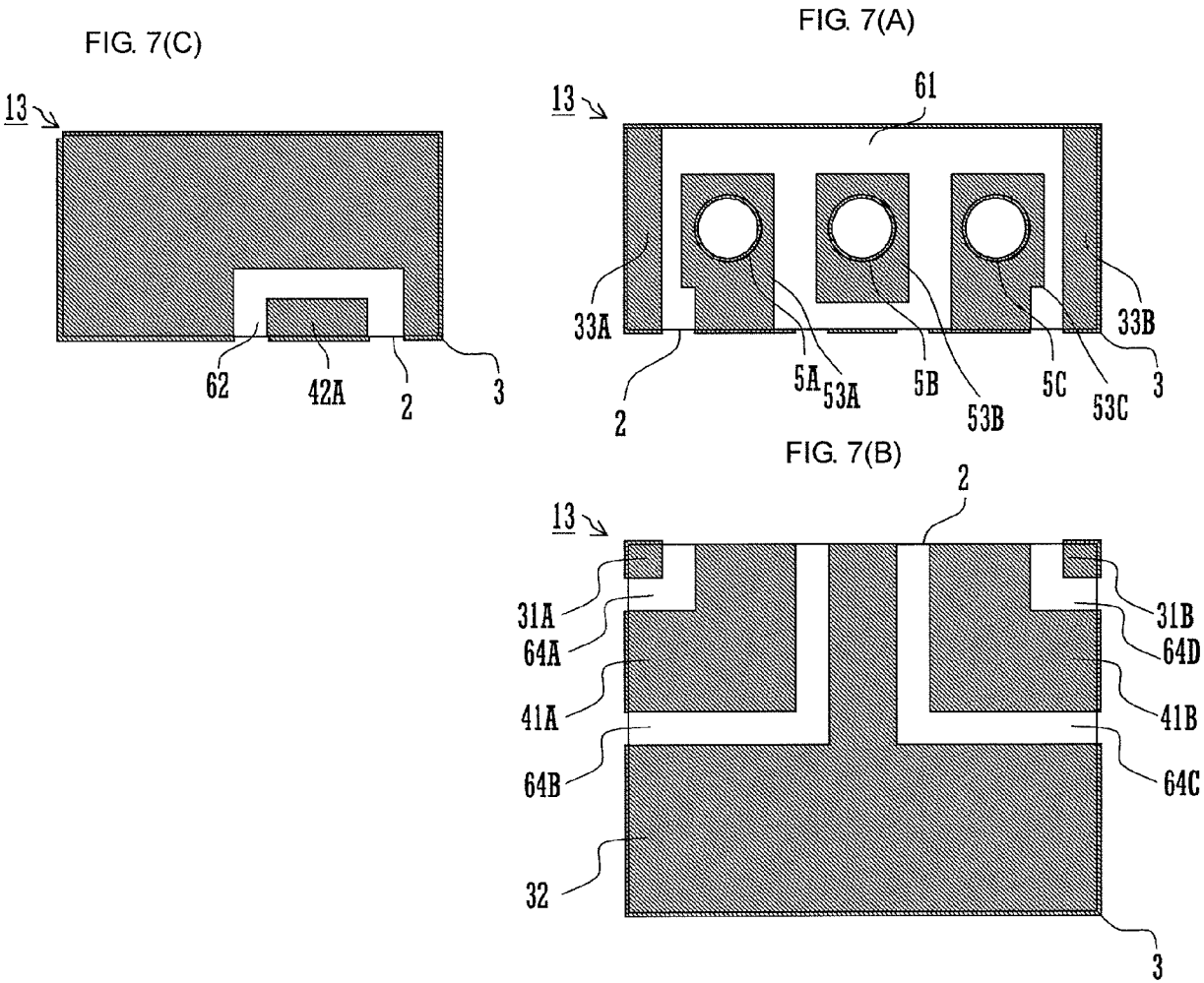
FIG. 7(A) to 7(C) are diagrams describing another exemplary configuration of a dielectric filter.

FIGS. 7(A) to 7(C) are developed views of a dielectric filter 13. In the drawing, the same reference numerals are used to represent the same components included in the above-described dielectric filters.

On the outer surface of the dielectric block 2, front surface open electrode portions 53A, 53B, 53C are disposed. The front surface open electrode portions 53A and 53C (as shown in FIG. 7(A)) are electrically connected to the undersurface input/output electrode portions 41A and 41B, respectively (as shown in FIG. 7(B)).

The side surface input/output electrode portion 42A (as shown in FIG. 7(C)) and the undersurface input/output electrode portion 41A are very strongly coupled to the inner conductor 5A (as shown in FIG. 7(A)) by the front surface open electrode portion 53A, and the side surface input/output electrode portion opposite to the side surface input/output electrode portion 42A (not shown) and the undersurface input/output electrode portion 41B are very strongly coupled to the inner conductor 5C (as shown in FIG. 7(A)) by the front surface open electrode portion 53C, so that very strong external coupling can be obtained.

It should be understood that the above-described embodiments are illustrative only and are not intended to limit the scope of the present invention. The scope of the present invention should be determined in view of the appended claims. Accordingly, equivalents to the appended claims and all modifications of the present invention which fall within the scope of the present invention are intended to be encompassed in the scope of the present invention.

The invention claimed is:

1. A dielectric filter comprising:

a dielectric block disposed on a mount board, an undersurface of the dielectric block being a mounting surface;

an outer conductor on an outer surface of the dielectric block and connected to a ground on the mounting surface;

an inner conductor on an inner surface of an inner conductor formation hole that passes through the dielectric block, the inner conductor having an open end on a front surface of the dielectric block; and an input/output electrode separated from the outer conductor and coupled to the inner conductor, wherein the input/output electrode includes, on the undersurface of the dielectric block, undersurface input/output electrode portions, a first of the undersurface input/output electrode portions extending from a boundary between a first side surface and the undersurface of the dielectric block to a boundary between the front surface and the undersurface of the dielectric block, and a second of the undersurface input/output electrode portions extending from a boundary between a second side surface and the undersurface of the dielectric block to the boundary between the front surface and the undersurface of the dielectric block, and wherein the outer conductor includes, on the undersurface of the dielectric block, undersurface electrode corner portions, a first undersurface electrode corner portion disposed at a first corner formed by the front surface and the first side surface of the dielectric block and a second undersurface electrode corner portion disposed at a second corner formed by the front surface and the second side surface of the dielectric block, and an undersurface electrode main portion disposed between the undersurface electrode corner portions and is separated from the undersurface input/output electrode portions.

2. The dielectric filter according to claim 1, wherein the outer conductor includes front surface electrode portions on the front surface of the dielectric block, a first of the front surface electrode portions extending from the boundary between the undersurface and the front surface of the dielectric block to a boundary between an upper surface and the front surface of the dielectric block along the first side surface of the dielectric block, and a second of the front surface electrode portions extending from the boundary between the undersurface and the front surface of the dielectric block to the boundary between the upper surface and the front surface of the dielectric block along the second side surface of the dielectric block.

3. The dielectric filter according to claim 1, wherein the inner conductor is a plurality of inner conductors arranged adjacent to each other, and wherein coupling electrodes are provided on the front surface of the dielectric block, each of the coupling electrodes being individually connected to respective open ends of the plurality of inner conductors so as to generate a mutual capacitance between the respective open ends of the plurality of inner conductors.

4. The dielectric filter according to claim 3, wherein a first of the coupling electrodes and the respective inner conductor connected thereto provides an input-stage resonator and a second of the coupling electrodes and the respective inner conductor connected thereto provides an output-stage resonator, the first and second coupling electrodes being individually connected to the undersurface input/output electrode portions.

5. The dielectric filter according to claim 1, wherein a front surface strip electrode is provided on the front surface of the dielectric block, ends of the front surface strip electrode being connected to the outer conductor.

6. The dielectric filter according to claim 5, wherein the front surface strip electrode is symmetric about a central plane passing through the front surface of the dielectric block.

7. A dielectric filter comprising:

a dielectric block having an outer surface, the outer surface including opposed top and bottom surfaces, opposed first and second side surfaces, and a front surface;

an outer conductor on the outer surface of the dielectric block;

a plurality of inner conductor holes in the dielectric block, each of the plurality of inner conductor holes having an open end on the front surface of the dielectric block;

a first input/output electrode on the bottom surface of the dielectric block, the first input/output electrode being separated from the outer conductor and coupled to a first inner conductor hole of the plurality of inner conductor holes, the first input/output electrode being shaped so as to curve from a first boundary between the first side surface and the bottom surface of the dielectric block to a second boundary between the front surface and the bottom surface of the dielectric block;

a second input/output electrode on the bottom surface of the dielectric block, the second input/output electrode being separated from the outer conductor and coupled to a second inner conductor hole of the plurality of inner conductor holes, the second input/output electrode being shaped so as to curve from a third boundary between the second side surface and the bottom surface of the dielectric block to the second boundary between the front surface and the bottom surface of the dielectric block;

a first electrode corner portion on the bottom surface of the dielectric block at a first corner between the front surface and the first side surface of the dielectric block;

a second electrode corner portion on the bottom surface of the dielectric block at a second corner between the front surface and the second side surface of the dielectric block; and an electrode main portion on the bottom surface of the dielectric block between the first and second electrode corner portions and separated from the first and second input/output electrodes.

8. The dielectric filter according to claim 7, wherein the outer conductor includes front surface electrode portions on the front surface of the dielectric block, a first of the front surface electrode portions extending from the second boundary between the bottom surface and the front surface of the dielectric block to a fourth boundary between the top surface and the front surface of the dielectric block along the first side surface of the dielectric block, and a second of the front surface electrode portions extending from the second boundary between the bottom surface and the front surface of the dielectric block to the fourth boundary between the top surface and the front surface of the dielectric block along the second side surface of the dielectric block.

9. The dielectric filter according to claim 7, further comprising coupling electrodes on the front surface of the dielectric block, each of the coupling electrodes being individually connected to respective open ends of the plurality of inner conductor holes so as to generate a mutual capacitance between the respective open ends of the plurality of inner conductor holes.

10. The dielectric filter according to claim 9, wherein a first of the coupling electrodes and the respective inner conductor hole connected thereto provides an input-stage resonator and is connected to the first input/output electrode, and a second of the coupling electrodes and the respective inner conductor hole connected thereto provides an output-stage resonator and is connected to the second input/output electrode.

11. The dielectric filter according to claim 7, further comprising a front surface strip electrode provided on the front surface of the dielectric block, respective ends of the front surface strip electrode being connected to the outer conductor.

12. The dielectric filter according to claim 11, wherein the front surface strip electrode is symmetric about a central plane passing through the front surface of the dielectric block.

* * * * *